US007853182B2

(12) United States Patent
Lange

(10) Patent No.: US 7,853,182 B2
(45) Date of Patent: Dec. 14, 2010

(54) VARIABLE VOLUME TONER REPLENISHER DISPENSER FOR TIPP SYSTEMS

(75) Inventor: Clark Vaughn Lange, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 514 days.

(21) Appl. No.: 11/950,098

(22) Filed: Dec. 4, 2007

(65) Prior Publication Data

US 2009/0142085 A1 Jun. 4, 2009

(51) Int. Cl.
*G03G 15/08* (2006.01)
*B41J 2/175* (2006.01)

(52) U.S. Cl. ..... 399/258; 399/27; 399/120; 347/85

(58) Field of Classification Search ..... 399/27, 399/57, 120, 238, 258, 262; 346/84, 85, 346/140; 347/84, 85, 140
See application file for complete search history.

(56) References Cited

U.S. PATENT DOCUMENTS

| | | | | |
|---|---|---|---|---|
| 2003/0152394 | A1* | 8/2003 | Nakase et al. | 399/27 |
| 2004/0052538 | A1* | 3/2004 | Yugeta et al. | 399/27 |
| 2005/0185990 | A1* | 8/2005 | Ahn | 399/258 |
| 2006/0159472 | A1* | 7/2006 | Ushiroji et al. | 399/27 |
| 2006/0165423 | A1* | 7/2006 | Nishitani et al. | 399/27 |

* cited by examiner

*Primary Examiner*—David M Gray
*Assistant Examiner*—Joseph S Wong
(74) *Attorney, Agent, or Firm*—Fay Sharpe LLP

(57) ABSTRACT

A printing fluid dispenser system for multi-printer engine assembly is disclosed. The system includes a first dispenser that is adjacent to the print engine that is configured to pass printing fluid to an associated printing engine, a second dispenser adjacent to the first dispenser that is configured to store the printing fluid and pass the printing fluid to the first dispenser as the first dispenser passes the printing fluid to the printing engine and a sensor configured to detect when the printing fluid remaining in one of the first or second dispensers drops below a predetermined threshold.

20 Claims, 4 Drawing Sheets

VARIABLE VOLUME TONER REPLENISHER DISPENSER FOR TIPP SYSTEMS

CROSS REFERENCE TO RELATED PATENTS AND APPLICATIONS

The following applications, the disclosure of each being totally incorporated herein by reference as mentioned.

U.S. Publication No. US-2006-0114497-A1, Published Jun. 1, 2006, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. Publication No. US-2006-0067756-A1, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Publication No. US-2006-0067757-A1, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Pat. No. 7,188,929, Issued Mar. 13, 2007, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Publication No. US-2006-0197966-A1, Published Sep. 7, 2006, entitled "GRAY BALANCE FOR A PRINTING SYSTEM OF MULTIPLE MARKING ENGINES," by R. Enrique Viturro, et al.;

U.S. Publication No. US-2006-0285159-A1, Published Dec. 21, 2006, entitled "METHOD OF ORDERING JOB QUEUE OF MARKING SYSTEMS," by Neil A. Frankel;

U.S. Publication No. US-2007-0195355-A1, published Aug. 23, 2007, entitled "MULTI-MARKING ENGINE PRINTING PLATFORM", by Martin E. Banton;

U.S. application Ser. No. 11/432,993, filed May 12, 2006, entitled "TONER SUPPLY ARRANGEMENT", by David G. Anderson;

U.S. application Ser. No. 11/890,084, filed Aug. 3, 2007, entitled "COLOR JOB OUTPUT MATCHING FOR A PRINTING SYSTEM", by Daniel Bray.

The following relates to the printing and marking arts and finds particular application in conjunction with efficiency control of printing systems with multiple marking engines and will be described with particular reference thereto. However, it should be appreciated that some embodiments are amenable to other applications.

Conventional printing systems can include multiple marking engines, multiple media paths, and one or more multiple destinations. Printing systems may also include multiple toner/replenisher supply stations. In xerographic Tightly Integrated Parallel Processing (TIPP) systems, these toner/replenisher supply stations often require regular attention. Whenever a toner/replenisher supply bottle runs low in a printing system it must be replaced in order to continue printing. This problem becomes more defined in TIPP systems. For example, a two engine black and white TIPP xerographic system would require monitoring in each system. Therefore, two engine TIPP system would require twice as much monitoring as a single engine system. The problem, however, becomes more difficult with the more engines in the TIPP system. For example, a four engine TIPP system would need a new toner/replenisher bottle four times as often as a single engine. Furthermore, a color TIPP system with four engines would require attention 16 toner/replenisher bottles. Therefore, this system would need to have its toner supply bottle replaced 16 (4×4) times as often. Without an improved design or service strategy, the operator will be required to very frequently interact with the printer in order to add toner/replenisher.

One solution to this problem is to redesign the system so that one large single source of color toner/replenisher could supply all of the engines. This system could be manageable in a smaller e.g., two engine TIPP system. The solution could become impractical as the number of engines grows. Furthermore, the plumbing system would be very difficult to implement for powder materials. Another possible solution includes a "smart" scheduling system. In this scenario, the job/print scheduler would attempt to balance the load to each engine such that particular colors could run out at approximately the same time. In this sense, the toner/replenisher supply bottles could be serviced at the same time. This system, however, is also difficult to manage because throughput is not easily calculated. This would invariably result in wasted toner/replenisher in some of the bottles. Again, this solution would also become increasingly difficult with an increasing number of print engines.

There is a need in the industry to develop a system that requires fewer customer interactions with respect to toner/replenisher supply. It would be useful if this idea could be easily implemented in existing TIPP systems. There is also a need in the industry for a solution that requires minimal reconfiguration of print engines. Moreover, there is a need in the industry for a system that will provide improved customer service, as well as customer satisfaction. This disclosure solves the above-referenced difficulties and others.

BRIEF DESCRIPTION

Aspects of the present disclosure and embodiments thereof include the following apparatus embodiments. A printing fluid dispenser system for a multi-printer engine assembly for managing throughput and minimizing operator intervention includes a first dispenser that is adjacent to an associated print engine. The first dispenser is configured to pass printing fluid to a developer housing in an associated print engine. The system also includes a second dispenser adjacent to the first dispenser that is configured to store the printing fluid and pass the printing fluid to the first dispenser as the first dispenser passes the printing fluid to the associated developer housing in the printing engine and a sensor that is configured to detect when the printing fluid remaining in one of the first or second dispensers drops below a predetermined threshold.

According to another aspect of the claimed disclosure, a system for dispensing toner includes a plurality of dispensers having two ends where the first end is configured to dispense printing toner to an adjacent dispenser or developer housing in a printing engine and the second end is configured to receive printing toner from an adjacent dispenser and a sensing mechanism configured to detect when the amount of printing toner falls below a predetermined threshold. This plurality of dispensers may be grouped so that at least two dispensers are included in a set and a set of dispensers corresponds to a color of the printing toner.

DETAILED DESCRIPTION

As disclosed in more detail below, this disclosure relates to an assembly that has a dispenser supply system that includes multiple bottles for each color for each printing engine in a printing system. This disclosure would allow for toner/replenisher to either exit from the bottom of the bottle, enter through the top of the bottle, or both. The general concept would include a series of bottles configured to interlock from top to bottom. Each set of bottles has a sensor detecting the system fill level. The system also has a master sensor that provides a signal to the customer when one of the sets requires an intervention. The operator may then refill all of the sets for each color, for each engine. In this sense, the system continues to operate until the next "required" intervention is reached. This overall strategy minimizes the amount of interventions required by a customer or operator and helps ensure that all toner/replenisher is used from each bottle. The system may be employed in multi-print engine systems, as well as single print engine systems.

Figure 1:
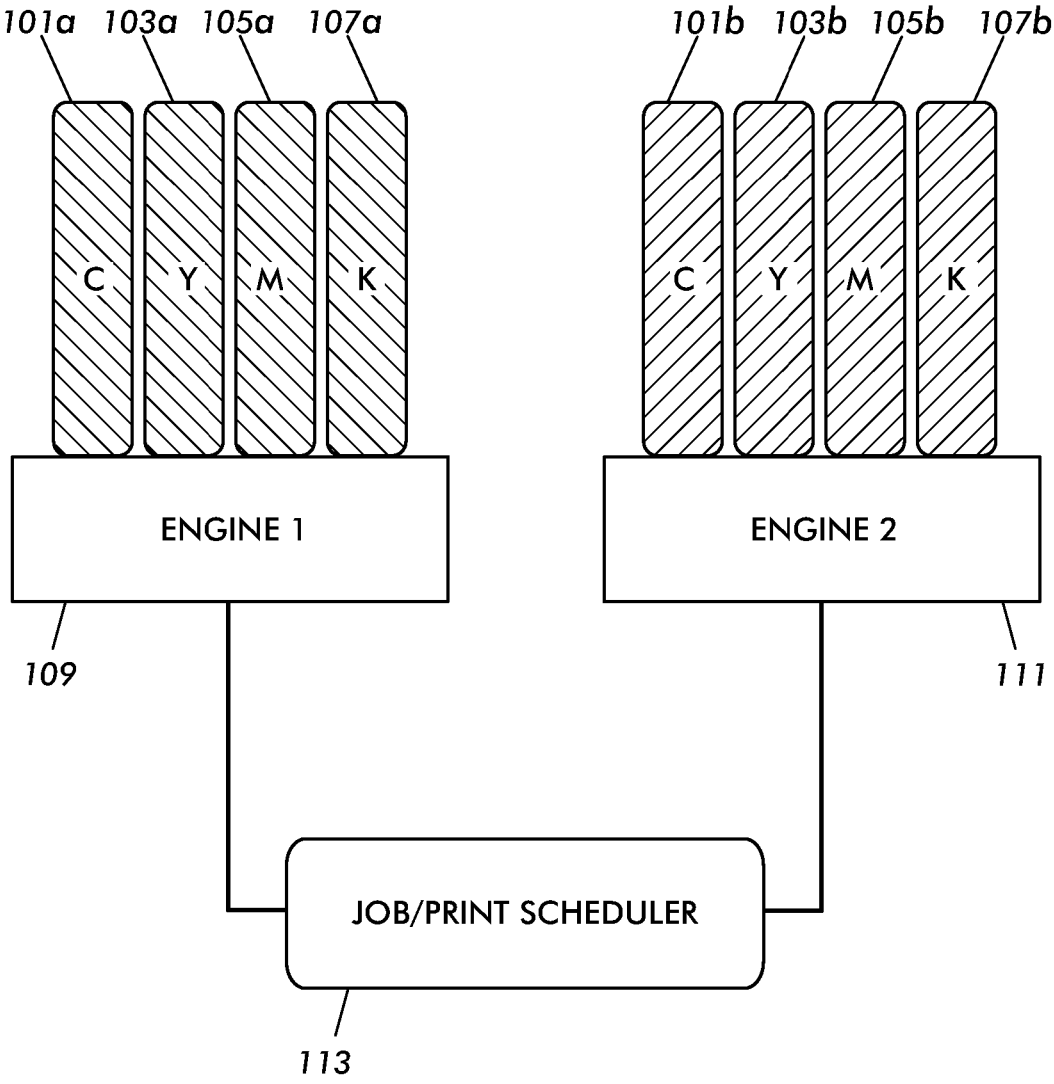
FIG. 1 PRIOR ART
FIG. 1 is a diagrammatic illustration of a printing fluid dispenser assembly.

Now referring to FIG. 1, which is a prior example of a printer fluid dispensing solution that is commonly used in printing systems. This system uses dispenser bottles 101*a* and *b*, 103*a* and *b*, 105*a* and *b* and 107*a* and *b*. Each dispensing bottle corresponds to a color and is in communication with a printing engine 109, 111. Both of these engines are in communication with a job/print scheduler 113.

A required intervention happens each time one of the bottles (for example, the cyan colored bottle 101*a*) runs low. Under this system there is the possibility of eight different required interventions. If any one bottle runs out of printer fluid, generally the printer system will have to stop until the printer fluid is replenished. Unfortunately, under this system it would be wasteful to replace a color if it has not completely run dry. In this form, if the cyan 101*a* from print engine 1, 109 has run low and the yellow 103*b* from print engine 2, 111 will run low in five minutes, the system would have to be stopped to refill each color individually. This system requires frequent intervention in order to keep the printer system as a whole, running. The job/print scheduler 113, through some of the prior art embodiments attempts to schedule the engines so that the printing load is balanced. However, the precise control of throughput often cannot be exactly managed and can result in diminished efficiency.

Figure 2:
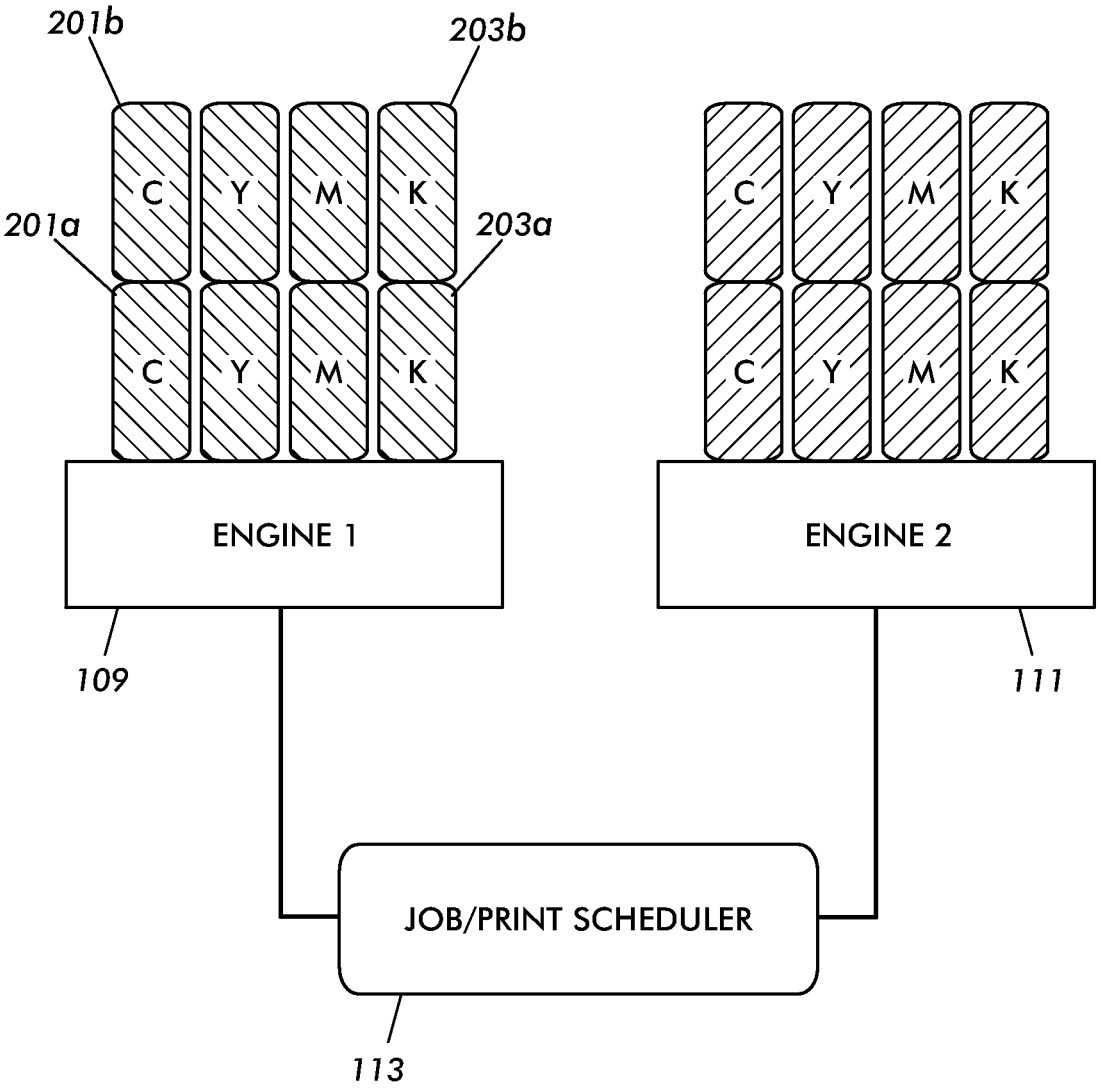
FIG. 2 is a diagrammatic illustration of the example printer fluid dispensing assembly according to the present disclosure.

Moving on to FIG. 2, which is one embodiment according to the present disclosure of the printer fluid dispensing assembly. FIG. 2 has a first dispenser 201*a* and a second dispenser 201*b*. Both dispensers are adjacent to one another. This is the case for each of the four colors, cyan (C), yellow (Y), magenta (M), and black (K). The two dispensers together form a set and each set corresponds to one color. In this form, when a bottle has run low enough to trigger the sensor, the operator can replace that bottle and incorporate a top-off strategy, which is shown in further detail in FIG. 4.

Figure 3:
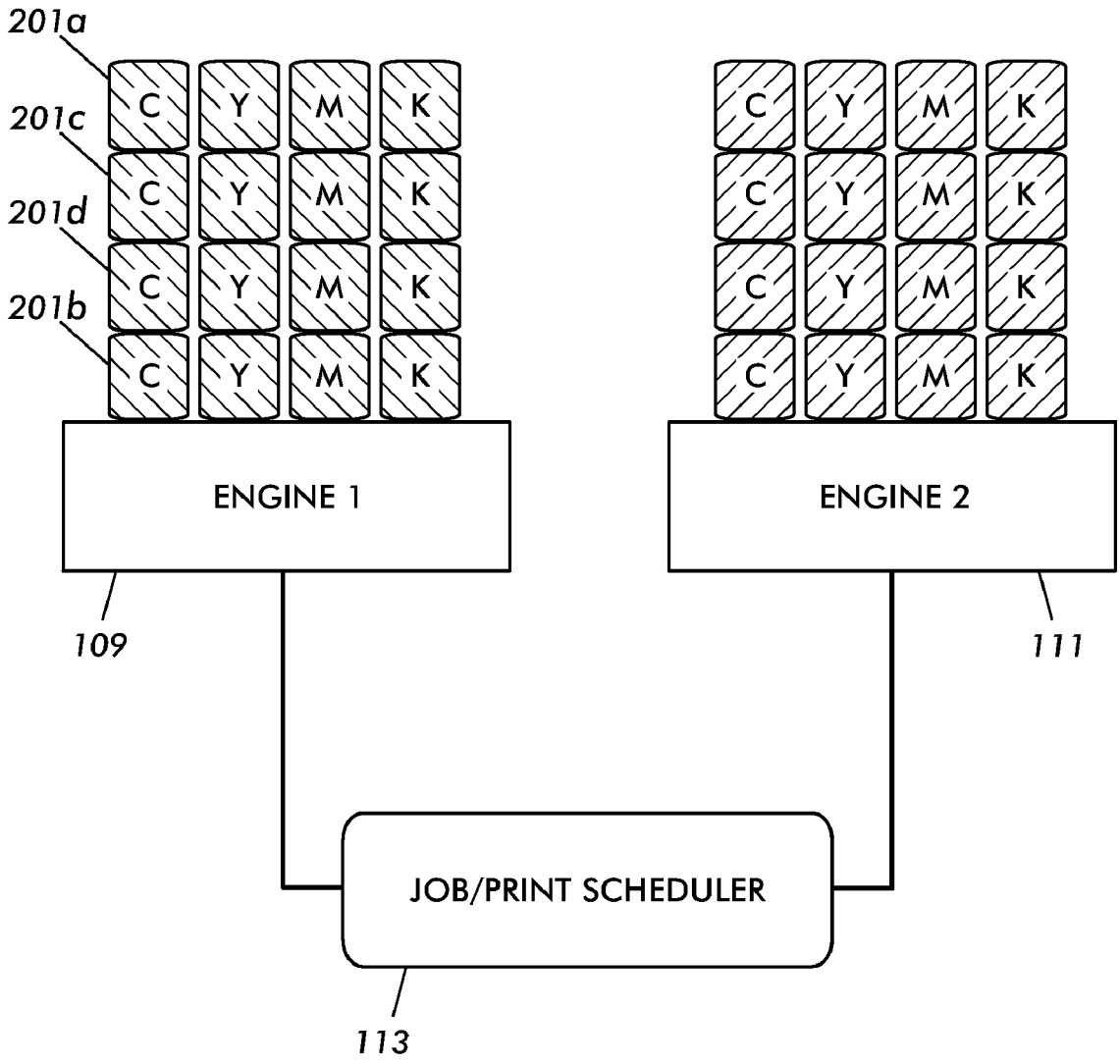
FIG. 3 is a diagrammatic illustration of another embodiment of the printer fluid dispensing assembly according to the present disclosure.

Now referring to FIG. 3 which demonstrates another embodiment of a printer fluid dispensing assembly. This embodiment includes four smaller bottles for each set. Again, each set represents one color for one engine. It should be noted, however, that this is but one embodiment of the disclosure and a set may include any number of bottles and still fit within the spirit of the claims.

Continuing on with FIG. 3, in this embodiment four bottles are shown, to make up a set. Each of these bottles 201*a* through *d*, represent one color per print engine 109. This figure demonstrates one form in which the bottles 201*a* through 201*d* may interlock. These bottles are stacked so that the toner/replenisher will empty throughout the top bottle into the bottom bottle through the flow of gravity or some other mechanical means. The printing fluid inside each bottle may be toner, replenisher, etc., depending on the print engine needs and/or requirements.

Figure 4:
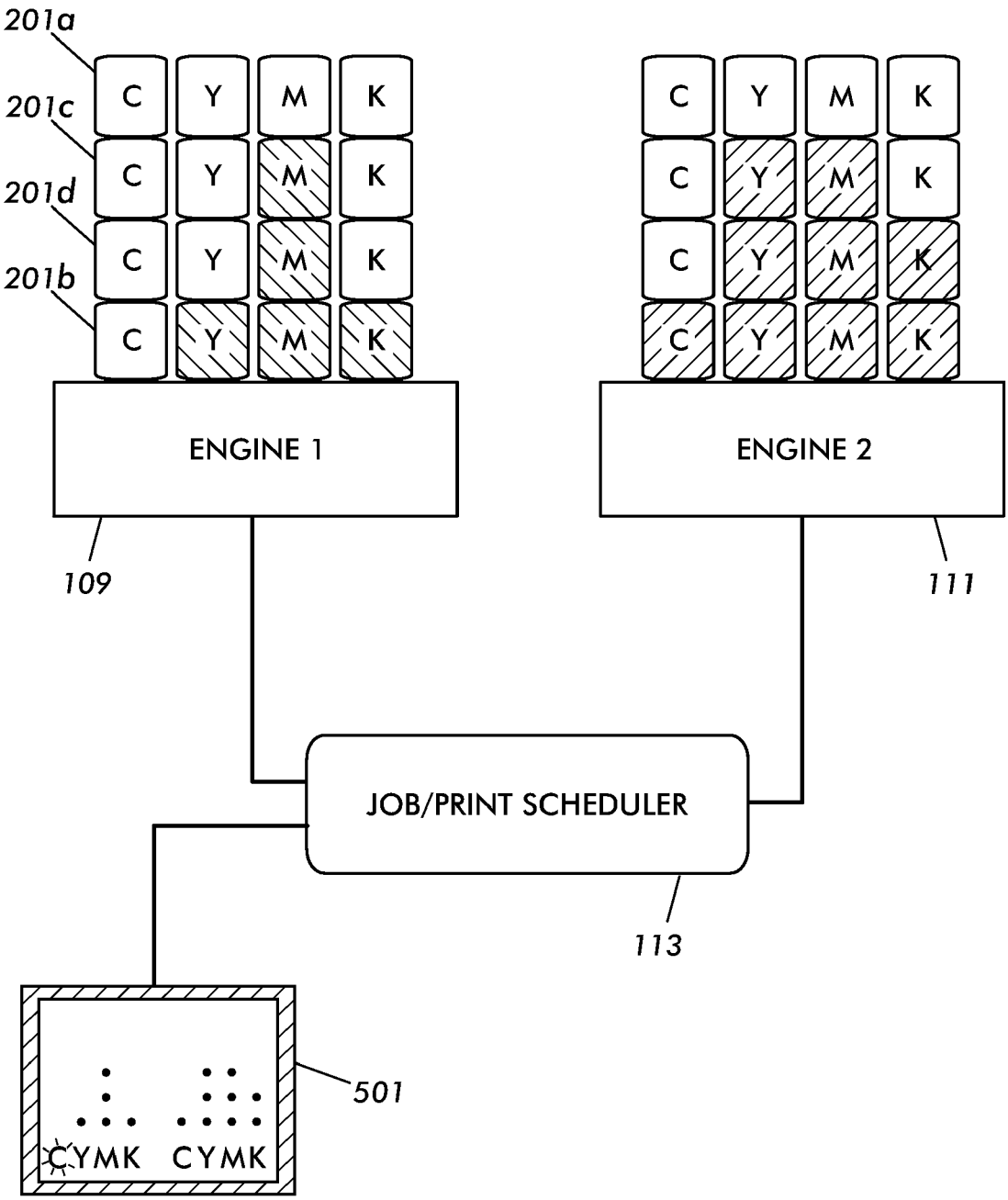
FIG. 4 is a diagrammatic illustration of yet another embodiment of a printer fluid dispensing assembly according to the present disclosure.

Now referring to FIG. 4 which is another embodiment of the printer fluid dispensing assembly. According to the present disclosure, FIG. 4 shows an embodiment that includes a user interface 501 that is in communication with the first printer engine 109, the second printing engine 111, the job print scheduler 113. The user interface may gather information from a sensing mechanism which may be located adjacent to each engine 109, 111. In one embodiment there is a sensing mechanism for each set of printing fluid dispensers. For example, there may be one sensor for cyan in engine 1, one sensor for yellow in engine 1, one sensor for magenta in engine 1, and one sensor for black in engine 1. Furthermore, there may also be one sensor apiece for cyan, yellow, magenta, and black in engine 2, making a total of eight sensors. Generally, each additional engine will have four additional sets and four additional sensors. The sensing may be done through opacity, infrared, weight measurement, pressure measurement, or any other means known in the art. The sensor is configured to detect how much printing fluid remains in the system. Furthermore, the sensor can signal when the printing fluid remaining drops below a predetermined threshold.

The user interface 511 is, in one embodiment, the conduit in which the user is notified. In one embodiment, the user interface is equipped with an alarm which tells the user when one or more of the sets has fallen below a predetermined threshold. In another embodiment, the user interface 511 includes LEDs which tell the level of printing fluid remaining in each set of dispensers.

When an intervention is required, a user, through this disclosure may implement a top-off strategy for each set that is not at its maximum. For example, as shown in FIG. 4, the cyan has fallen below the threshold for engine 1. Therefore, the user is notified that more cyan needs to be added to engine 1 in order to continue printing. However, the user can also see that yellow could use three more dispensers before it reaches capacity for engine 1, 109. Magenta could also use one more dispenser before it reaches capacity in engine 1, 109. And, lastly, black could use three more dispensers to reach capacity for engine 1, 109. The user interface 501 could also show that engine 2, 111, could use three more cyans, one more yellow, one more magenta, and two more black dispensers in order to reach capacity.

In one embodiment, these dispensers could be disposable, therefore, the empty dispensers, such as 201*a* through *d*, could simply be thrown away or discarded in some other manner, when the new dispensers are put into place. This could simplify the process of an intervention. In another embodiment the dispensers are sent to a separate location to be refilled.

The systems, as shown in FIG. 4, maximize time in between required interventions. For example, if the printing fluid was at the level that is shown in FIG. 4, however, the system of FIG. 1 (prior art) were implemented, the user would have no choice but to have either waste the amount of yellow toner by changing out the dispenser while he changed out the cyan, or in the alternative, do two different interventions and change the yellow whenever it runs empty. This could be a matter of moments or a matter of days. The system, as implemented, alleviates the user from making that choice. The user can simply top off the yellow toner while he is adding cyan color toner to the system minimizing the number of required interventions.

It will be appreciated that variations of the above-disclosed and other features and functions or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A multi printing toner dispenser system for a multi print engine assembly used in order to manage throughput and minimize operator intervention comprising:

a first dispenser that is adjacent to a developer housing in an associated print engine, where said first dispenser is configured to pass printing toner to said developer housing in the associated print engine;

a second dispenser adjacent to said first dispenser that is configured to store said printing toner and pass said printing toner to said first dispenser as said first dispenser passes said printing toner to said developer housing in the associated printing engine, wherein the second dispenser completely passes printing toner to the first dispenser using gravitational flow; and a sensor configured to detect when printing toner remaining in one of said first or second dispensers drops below a predetermined threshold.

2. The system according to claim 1, wherein said printing toner is replenisher.

3. The system according to claim 1, wherein said multi-printing toner dispenser is used in a single engine printing system.

4. The system according to claim 1, wherein said sensor triggers an alarm.

5. The system according to claim 1, wherein said system is configured for a color printing system, where each color has at least said first and second dispenser.

6. The system according to claim 5, further comprising at least one sensor for each color configured to detect when printing toner remaining in one said dispensers drops below a predetermined threshold.

7. The system according to claim 1, further comprising an operator interface that signals to a user when said sensor has detected that the printing toner remaining in one of said first or second dispensers drops below a predetermined threshold.

8. The system according to claim 1, further comprising at least one more dispenser that is configured to store said printing toner and pass said printing toner to one of said first or second dispenser.

9. The system according to claim 1 wherein said first dispenser is removably attached to said second dispenser so that said second dispenser may be removed from said system when empty while said first dispenser continues to pass printing toner to said print engine uninterrupted.

10. The system according to claim 1, further comprising multiple print engines each having said first and said second dispensers corresponding to each said print engine, where said print engines are in communication with each other in order to produce a document.

11. A system for dispensing toner or replenisher comprising:

a plurality of dispensers having two ends, where said first end is configured to dispense printing toner to an adjacent dispenser or a print engine and said second end is configured to receive printing toner from an adjacent dispenser, wherein the first end passes printing toner to the adjacent dispenser using only gravitational flow; and a sensing mechanism configured to detect when the amount of printing toner fall below a predetermined threshold.

12. The system according to claim 11 wherein said printing toner includes toner.

13. The system according to claim 11 wherein said printing toner includes a mixture of toner and carrier.

14. The system according to claim 11 wherein said plurality of dispensers are grouped so that at least two dispensers are included in a set, where each set corresponds to a color of said printing toner.

15. The system according to claim 14 further comprising at least one sensing mechanism for each said set.

16. The system according to claim 15 further comprising a user interface that signals when said sensing mechanism detects that the amount of printing toner has fallen below the predetermined threshold.

17. The system according to claim 16 wherein said user interface includes light emission diodes to signal the amount of printer toner printing toner remaining for each set.

18. The system according to claim 11 wherein said first side of each dispenser is configured to interlock with the second side of other dispensers.

19. The system according to claim 11 wherein said print engine is part of an integrated print engine system including multiple print engines in communication with one another.

20. A xerographic imaging system comprising:

a plurality of dispensers having two ends, where said first end is configured to dispense printing toner to an adjacent dispenser or a print engine and said second end is configured to receive printing toner from an adjacent dispenser using only gravitational flow, where said plurality of dispensers are grouped so that at least two dispensers are included in a set, where each set corresponds to a color of said printing toner; and a plurality of sensing mechanisms configured to detect when the amount of printing toner falls below a predetermined threshold, where each sensing mechanism corresponds to a set.

* * * * *